United States Patent [19]

de Leeuw

[11] 4,046,515

[45] Sept. 6, 1977

[54] DILUTING AND AGITATING DEVICE

[76] Inventor: Jan de Leeuw, Mistelvagen 9, Akersberga, Sweden

[21] Appl. No.: 665,291

[22] Filed: Mar. 9, 1976

[30] Foreign Application Priority Data

Mar. 27, 1975 Sweden ..... 7503588

[51] Int. Cl.[2] ..... B01F 11/04

[52] U.S. Cl. ..... 23/259; 259/19; 259/DIG. 46

[58] Field of Search ..... 23/259, 292; 259/DIG. 46, 19, 27, 112, 114

[56] References Cited

U.S. PATENT DOCUMENTS

| | | | |
|---|---|---|---|
| 1,422,560 | 7/1922 | Gibbs | 23/259 X |
| 2,084,651 | 6/1937 | Mecklenburg et al. | 23/259 UX |
| 3,780,992 | 12/1973 | Nishi et al. | 259/19 |

*Primary Examiner*—Robert M. Reese

*Attorney, Agent, or Firm*—George H. Mitchell, Jr.

[57] ABSTRACT

Apparatus for simultaneously adding liquid to a test tube and agitating the resulting contents consists of a mounting for a pipette to discharge liquid into the test tube, with a vibratory agitator also supported by the mounting, and having its lower end extending into the test tube below the level of the pipette.

3 Claims, 2 Drawing Figures

DILUTING AND AGITATING DEVICE

The present invention refers to a device for diluting liquid into a test tube or similar vessel and for agitating the contents of the test tube, the device comprising a pipette to be introduced into the test tube. The device is especially suited for use in connection with automatic equipment for performing chemical analysis but it is not limited to this specific area of use.

In devices for diluting and agitating the contents of a test tube known per se, the means for these two functions have been separate so as to require the addition of liquid in one position and agitating the contents in another position of the test tube. In order to obtain reliable and reproduceable analysis results it is however desirable that the agitation of the contents of the test tube could be made without the loss of time involved in moving the test tube from one position to the next. This is especially the case when enzymatic reactions are to be detected in the tube. It is an object of the present invention to provide a device which meets these requirements, the characteristics of the invention appearing from the enclosed claims.

A preferred embodiment of the invention is described in connection with the enclosed drawing where:

Figure 1:
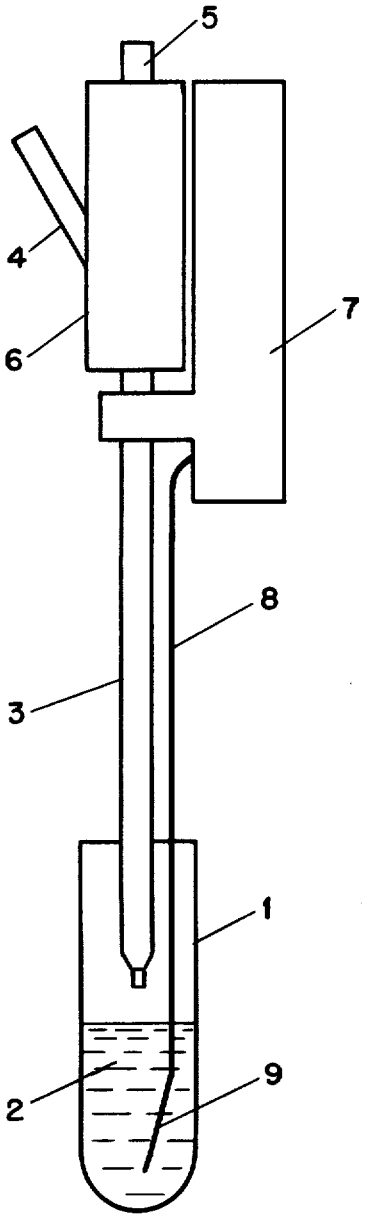
FIG. 1 is a side-view of the device according to the invention.

In the drawing reference 1 denotes a test tube or similar vessel which in this case is supposed to contain a certain amount of liquid 2 to which another liquid for instance a reagent is to be added, through a pipette 3. This pipette could be subject to an air-flow for removing drops and air is then supplied through a connection 4. Through a connection 5 the pipette is connected with means not shown in the drawing, such as containers for the reagent, pumps, controlable valves etc. The pipette 3 is carried by a holder 6 which is attached to driving and jounalling means 7 for a wire agitator 8. The major part of the agitator 8 is parallel to the pipette 3 but at its lower end 9 the agitator is bent under the lower end of the pipette 3.

Figure 2:
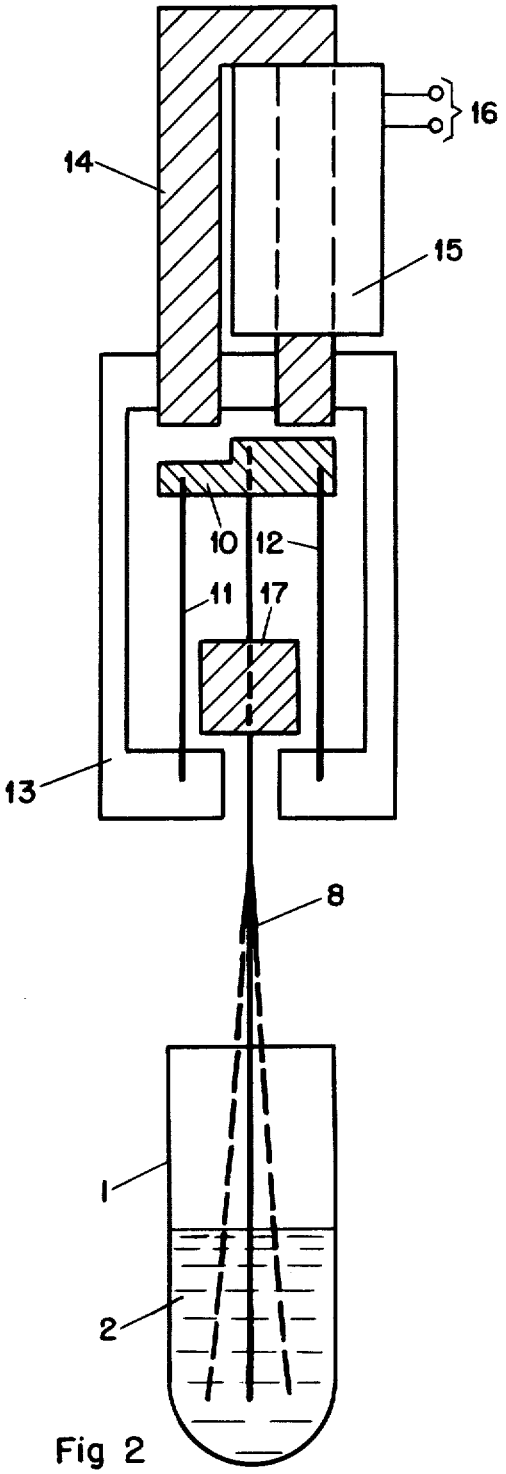
FIG. 2 is a cross-section on an enlarged scale of certain parts of the device in FIG. 1.

The driving and journalling means for the agitator 8 is shown in FIG. 2 together with the test tube 1 with the liquid 2. Thus the upper part of the agitator 8 is united with an anchor 10 which is suspended in two parallel flat springs 11 and 12 the lower parts of which are rigidly connected to a cover 13. The anchor 10 is coupled to a core 14 of an electro magnet, the coil 15 of which is supplied with alternating current via terminals 16. The alternating magnetic field of the core 14 will thus generate an oscillation of the anchor 10 in a plane parallel to the drawing.

Below the anchor 10 but preferably within the cover 13 the agitator 8 could be provided with a heavy body 17. By means of this body the oscillating amplitude of the agitator will be low at the body whereas the lower end 9 of the agitator will have the highest amplitudes.

The means for controlling the supply of liquid through the pipette 3 and for effecting the agitator 8 are coordinated in such a way that the movement of the agitator is initiated when the lower end of the agitator has reached the liquid 2, whereafter further liquid is supplied through the pipette 3. The control means could further be designed so as to make the agitator 8 continue to oscillate above the surface of the liquid when the device is raised or the test tube lowered, whereby remaining drops of liquid are shaken away from the agitator thus eliminating the risk of contamination to the next test tube.

By using the device according to the invention an immediate agitating of the liquid supplied through the pipette 3 and the liquid already present in the test tube 1 is obtained. Thus the test tube does not have to be moved from one position where liquid is added to a second position for agitation.

We claim:

1. Apparatus for dispensing a liquid into a succession of test tubes, or similar vessels, and for agitating liquid in the test tubes, comprising a pipette and an elongated wire agitator, supporting means for the pipette and said agitator including driving means and journalling means for positioning one end of the agitator for transverse vibratory movement in the liquid in a test tube, said one end being disposed below the level of the discharge end of the pipette, whereby only said one end of the agitator is immersed in the liquid while in a test tube.

2. The invention defined in claim 1, wherein said driving and journalling means includes means for generating an alternating magnetic field and for supporting and anchor in said magnetic filed for oscillatory movement, the other end of said agitator being secured to said anchor, and a heavy body being attached to the agitator at a location speced from said anchor.

3. The invention defined in claim 1, wherein said agitator is disposed along the major portion of its length parallel to said pipette, the lower end portion of the agitator being directed beneath the discharge opening of the pipette.

* * * * *